United States Patent [19]

Marshall et al.

[11] Patent Number: 4,633,233

[45] Date of Patent: Dec. 30, 1986

[54] WINDOW SECURITY DEVICE

[75] Inventors: John M. Marshall, 202 S. Michigan St., South Bend, Ind. 46601; James D. Hall, South Bend, Ind.

[73] Assignee: John M. Marshall, South Bend, Ind.

[21] Appl. No.: 702,584

[22] Filed: Feb. 19, 1985

[51] Int. Cl.[4] ..... G08B 13/00

[52] U.S. Cl. ..... 340/550; 340/541; 340/626; 200/61.93

[58] Field of Search ..... 340/550, 626, 540, 541, 340/544, 545; 200/61.93

[56] References Cited

U.S. PATENT DOCUMENTS 1,974,779 9/1934 Lupold et al. ..... 340/626 X 3,441,924 4/1969 Peek et al. ..... 52/790 X

*Primary Examiner*—James L. Rowland

*Assistant Examiner*—Jeffery A. Hofsass

*Attorney, Agent, or Firm*—James D. Hall

[57] ABSTRACT

A window security device adapted for use in a vacuum environment. The device includes a conductive seal in electrical communication with an alarm. When the vacuum is disturbed the seal falls out of contact with the alarm circuit, activating the alarm.

2 Claims, 9 Drawing Figures

Fig. 1
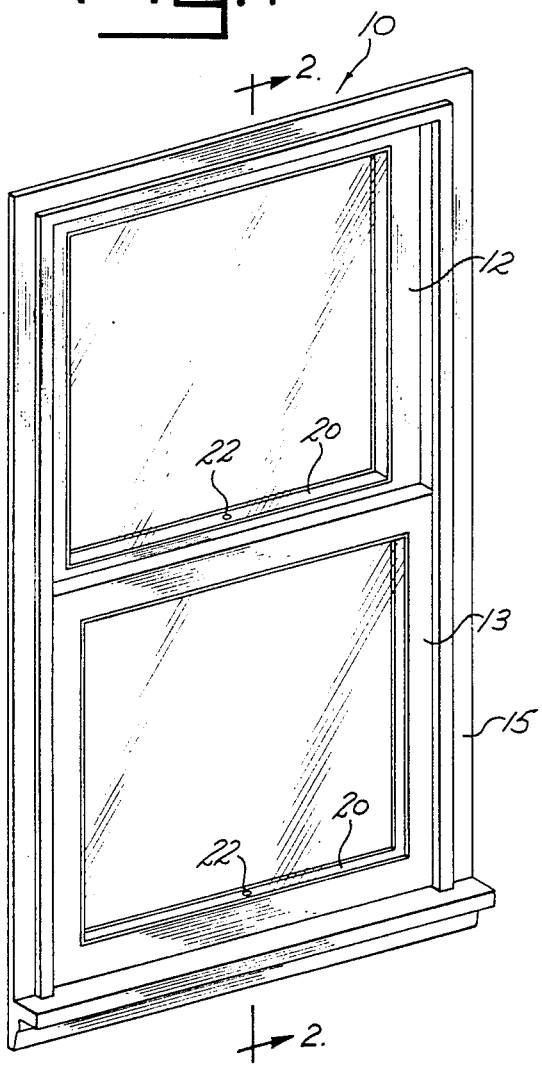
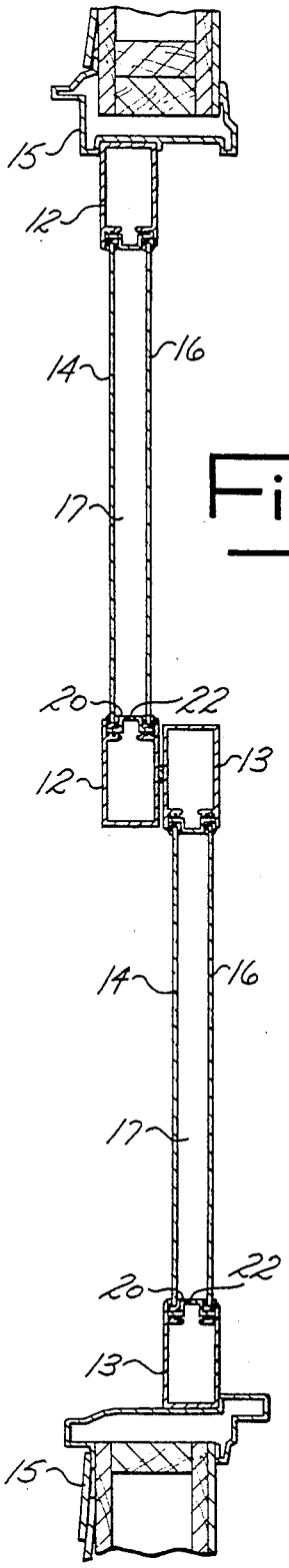
Fig. 2

WINDOW SECURITY DEVICE

SUMMARY OF THE INVENTION

This invention relates to a security device and will have special but not limited application to an activation device for a window burglar alarm.

The security of this invention is adapted for use in a vacuum-like environment. Typically, a hole is formed in the window frame between thermo-sealed glazing panels and a cover forming part of an alarm circuit is fitted over and hermetically seals the hole. When the vacuum is broken between glazing panels, such as by breaking one of the panels, the cover falls from the hole, breaking the alarm circuit and activating the alarm.

Accordingly, it is an object of this invention to provide for a novel improved window security device.

Another object of this invention is to provide for a gravity operated, vacuum environment activator for a burglar alarm.

Another object of this invention is to provide for a window security device which is efficient and economical.

Other objects of this invention will become apparent upon a reading of the following description.

BRIEF DESCRIPTION OF THE DRAWINGS

FIG. 1 is a perspective view of a double window utilizing the security device of this invention.

FIG. 2 is a cross sectional view taken along line 2—2 of FIG. 1.

DESCRIPTION OF THE PREFERRED EMBODIMENTS

The preferred embodiments herein described are not intended to be exhaustive or to limit the invention to the precise forms disclosed. They are chosen and described to explain the principles of the invention and their application and practical use to enable others skilled in the art to utilize the invention.

Figure 3:
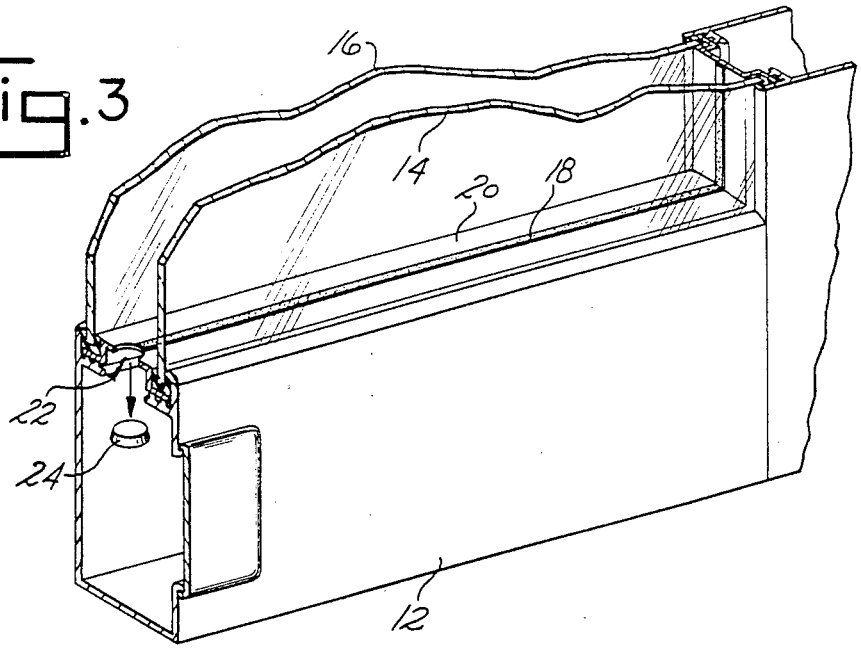
FIG. 3 is a fragmentary detailed perspective view of one double glazed window of FIG. 1.
Figure 4:
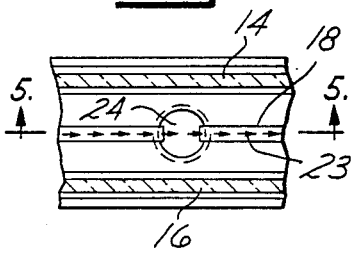
FIG. 4 is a top plan view in fragmentary sectional form of the window of FIG. 3.
Figure 5:
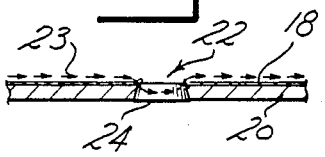
FIG. 5 is a sectional view taken along line 5—5 of FIG. 4.
Figure 6:
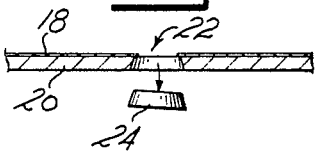
FIG. 6 is a view similar to FIG. 5 just subsequent to alarm activation.

The window security system of this invention is primarily adapted for use in a vacuum environment, such as in the double glazed window assembly 10 shown in FIGS. 1-3. Window assembly 10 includes top and bottom sashes 12,13 into which are carried spaced apart glazing panels 14,16. For insulation purposes, the space 17 between panels 14 and 16 is thermo-sealed, forming a vacuum. Sashes 12 and 13 fit slidably within a frame 15. A continuous conductive member such as metal security tape 18 is secured to spacer plate 20 between glazing panels 14,16 and is connected to an alarm circuit (not shown).

As shown in FIGS. 1-6 and preferably during assembly of the window, a hole 22 is formed in spacer plate 20 and interrupts the the continuity of tape 18. A plug 24, formed of electrically conductive material, is freely fitted into hole 22 as shown in FIGS. 3-6 and contacts tape 18 forming a complete circuit (see arrows 23) to the security alarm. Upon forming the vacuum in the space 15 between glazing panels 14,16, plug 24 remains in hole 22 in contact with tape 18. If one of he glazing panels 14,16 is broken, the vacuum between the panels is broken and plug 24 falls out through hole 22 due to gravity, breaking the circuit and activating the alarm.

Figure 7:
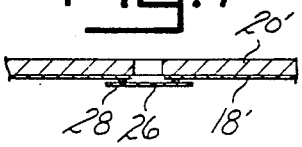
FIG. 7 is a fragmentary sectional view of a modified security means in use.
Figure 8:
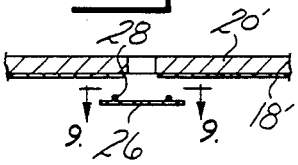
FIG. 8 is a view similar to FIG. 7 just subsequent to alarm activation.
Figure 9:
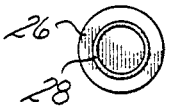
FIG. 9 is a view as seen from line 9—9 of FIG. 8.

A modified construction of the security system is shown in FIGS. 7-9. In this embodiment, metal security tape 18' is secured to the underside of the spacer strip 20'. A plate 26 which includes a centrally located integral raised conductive annulus 28 which is positioned beneath hole 22' such that the hole is completely sealed with annulus 28 overlying and contacting tape 18' to complete the electrical security circuit. Plate member 26 may be formed of graphite impregnated silicone. The vacuum between glazing panels holds plate 26 against window spacer strip 20'. As described above, when the vacuum is disturbed, such as by breaking one of the window glazing panels, plate 26 falls and is separated from tape 18', breaking the circuit and sounding the alarm.

It is to be understood that the above description does not limit the invention to the above-given details, but may be modified within the scope of the appended claims.

We claim:

1. In combination, a window security device and a window, said window having spaced apart glazing panels, a substantial vacuum formed between said glazing panels, said security device comprising an electric activator circuit positioned within said vacuum, said activator circuit adapted for connection to an alarm, and activation means for breaking said circuit and activating said alarm when said vacuum is disrupted, said activation means including a conductive seal means for completing said circuit and maintaining said vacuum, said seal means in contact with said activator circuit wherein distrubing one of said glazing panels activates said alarm, a spacer plate positioned between said window glazing panels, said spacer plate having a hole formed therethrough, said activator circuit including a continuous strip of conductive tape overlying said spacer plate, said tape interrupted at said hole, said conductive seal means including a plate member having a centrally located continuous conductive annulus, said plate member having a standby position adjacent said hole wherein said annulus seals said hole to maintain said vacuum, said annulus containing said conductive tape to complete said circuit when said plate is in its said standby position.

2. The combination of claim 1 wherein said activator circuit includes a continuous strip of conductive tape overlying said spacer plate, said tape interrupted at said hole, said conductive seal means including a plug formed of electrically conductive material freely fitted within said hole contacting said tape to complete said activator circuit.

* * * * *